US008074984B2

(12) United States Patent
Kurohata

(10) Patent No.: US 8,074,984 B2
(45) Date of Patent: Dec. 13, 2011

(54) SHEET STACKING APPARATUS AND IMAGE FORMING SYSTEM WITH AUTOMATICALLY CONTROLLED MOVING STAGE

(75) Inventor: Takao Kurohata, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 269 days.

(21) Appl. No.: 12/137,696

(22) Filed: Jun. 12, 2008

(65) Prior Publication Data

US 2009/0146368 A1 Jun. 11, 2009

(30) Foreign Application Priority Data

Dec. 11, 2007 (JP) ..... 2007-319357

(51) Int. Cl.
*B65H 39/10* (2006.01)

(52) U.S. Cl. ..... 271/292; 271/215; 271/288; 271/289; 271/298

(58) Field of Classification Search ..... 271/292, 271/298, 302–303, 215
See application file for complete search history.

(56) References Cited

FOREIGN PATENT DOCUMENTS

| | | | |
|---|---|---|---|
| JP | 10-139256 A | | 5/1998 |
| JP | 11-116122 A | | 4/1999 |
| JP | 11116122 A | * | 4/1999 |
| JP | 11-147649 A | | 6/1999 |
| JP | 11147649 A | * | 6/1999 |
| JP | 2004238187 A | * | 8/2004 |
| JP | 2005-162453 A | | 6/2005 |
| JP | 2006-219286 A | | 8/2006 |

OTHER PUBLICATIONS

Japanese Office Action dated Jan. 5, 2010 and English translation thereof issued in a counterpart Japanese Application No. 2007-319357.

* cited by examiner

*Primary Examiner* — Gerald McClain
(74) *Attorney, Agent, or Firm* — Holtz, Holtz, Goodman & Chick, PC

(57) ABSTRACT

A sheet stacking apparatus includes a stage, a driving unit to drive the stage, and a sheet detection device to detect that a sheet exists on the stage. Operation of the sheet stacking apparatus is controlled so that the stage descends in accordance with an amount of sheets to be stacked, and when a job executed in an image forming apparatus is completed, the stage automatically moves to a sheet removing position. The sheet stacking apparatus is controlled so that sheets of a mixing prohibition job are not stacked with sheets of another job, by detecting that a sheet of another job exists on the stage.

4 Claims, 9 Drawing Sheets

SHEET STACKING APPARATUS AND IMAGE FORMING SYSTEM WITH AUTOMATICALLY CONTROLLED MOVING STAGE

This application is based on Japanese Patent Application No. 2007-319357 on Dec. 11, 2007, in Japanese Patent Office, the entire content of which is hereby incorporated by reference.

BACKGROUND OF THE INVENTION

The present invention relates to a sheet stacking apparatus to stack a sheet and an image forming system having the sheet stacking apparatus thereof.

In recent years, a copying machine and a printer tend to increase in speed, and a consecutive output of a large amount of printed matters is often carried out. As a system which outputs a large amount of sheets consecutively, for example, there is an image forming system where an image forming apparatus is attached with a sheet stacking apparatus capable of stacking a large amount of sheets.

There are various kinds of sheet stacking apparatuses such as, for example, the sheet stacking apparatus described in Unexamined Japanese Patent Application Publication No. 2005-162453. Here, the sheet stacking apparatus of Unexamined Japanese Patent Application Publication No. 2005-162453 will be described. The sheet stacking apparatus has a stage to stack the sheets ejected from an image forming apparatus, and the stage descends gradually according to an amount of the sheets stacked. To remove the sheet stacked on the stage after a job executed in the image forming apparatus is completed, the stage is lowered to a predetermined removing position by pressing a sheet removing button and put it on a recovering trolley having caster wheels. Then a door of the sheet stacking apparatus is opened to withdraw the recovering trolley, thereby the sheet stacked on the stage can be brought out. By attaching the above sheet stacking apparatus to the image forming apparatus, a large amount of the sheets can be stacked and the large amount of heavy sheets having been stacked can be readily brought out.

[Patent Document 1] Unexamined Japanese Patent Application Publication No. 2005-162453

SUMMARY OF THE INVENTION

In the sheet stacking apparatus described in the Unexamined Japanese Patent Application Publication No. 2005-162453, when stacked sheets are removed after the job executed in the image forming apparatus is completed, an operation of "pressing sheet removing button" has to be carried out which is an onerous duty for an user. Also, the user has to press the sheet removing button and wait in front of the sheet stacking apparatus until the stage descends to the removing position, thus there is also a problem of wasting time in case of an apparatus capable of stacking a large amount of the sheets.

An aspect of the sheet stacking apparatus of the present invention is as follow. A sheet stacking apparatus, attached with an image forming apparatus to form an image on a sheet, for stacking the sheet ejected from the image forming apparatus has; a stage for stacking the sheet; a driving section to move the stage; and a control section which controls the driving section so that the stage moves automatically to a sheet removing position when a job executed in the image forming apparatus is completed.

Also, an aspect of the image forming system is as follow. The image forming system has an image forming apparatus to form an image on a sheet and the sheet stacking apparatus.

DETAILED DESCRIPTION OF THE PREFERRED EMBODIMENT

Figure 1:
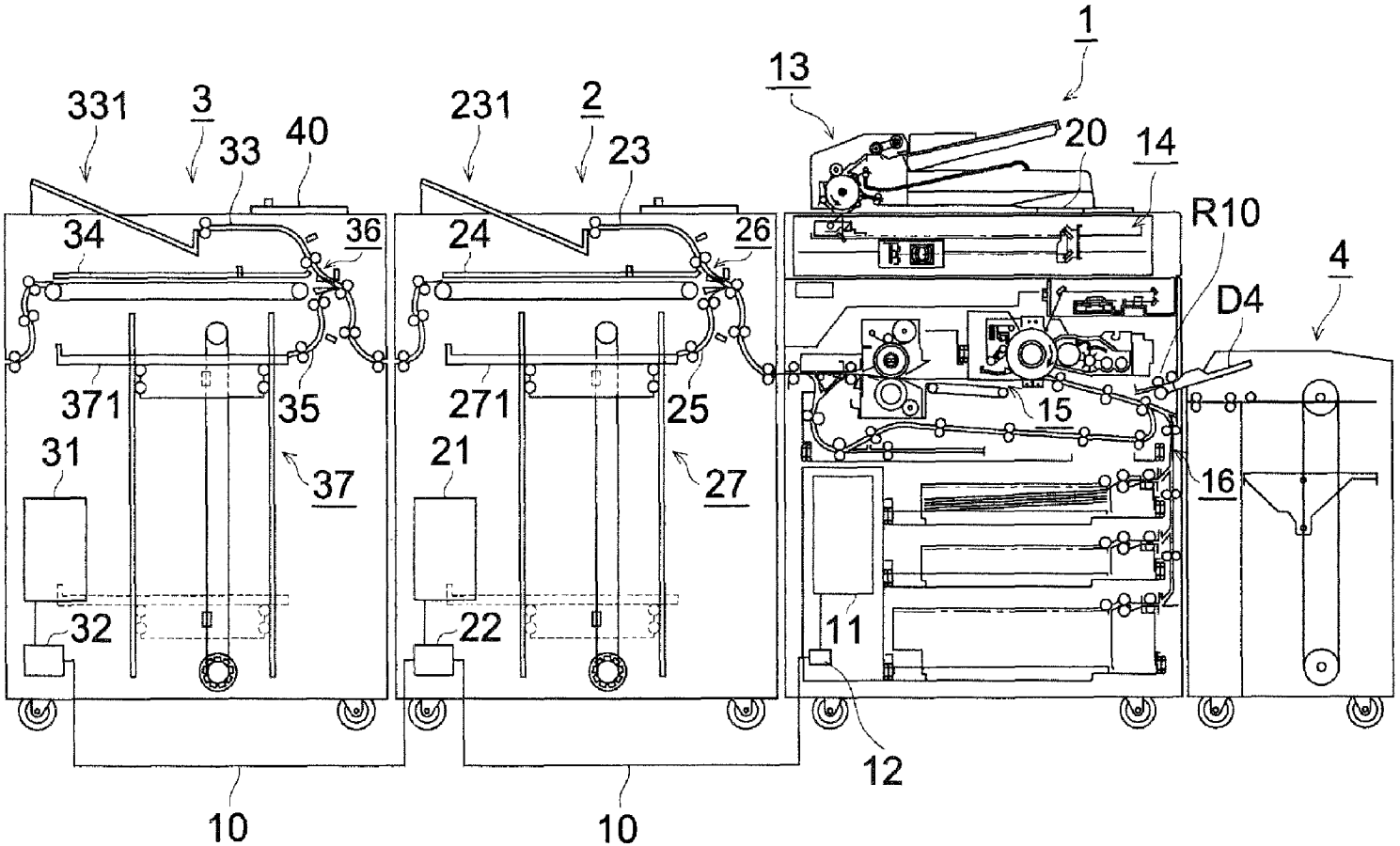
FIG. 1 is an overall structural view of an image forming system where two units of the sheet stacking apparatuses and a large capacity sheet feeding apparatuses are attached to an image forming apparatus.

FIG. 1 is an overall structural view of the image forming system where two units of sheet stacking apparatuses and a large capacity sheet feeding device are attached to an image forming apparatus.

In FIG. 1, a numeral 1 denotes an image forming apparatus, a numeral 2 denotes a sheet stacking apparatus attached to the image forming device 1, a numeral 3 is a sheet stacking apparatus attached to the sheet stacking apparatus 2, and a numeral 4 is a large capacity sheet feeding apparatus attached to the image forming apparatus 1. While in the image forming system shown in FIG. 1, two units of sheet stacking apparatuses 2 and 3 are attached to the image forming apparatus 1, more than two units of sheet stacking apparatus can be attached or only the sheet stacking apparatus 2 can be attached.

After a toner image is formed on a sheet P in the image forming apparatus 1, the sheet P is ejected from the image forming apparatus and conveyed to the sheet stacking apparatuses 2 and 3 attached at a downstream side in a sheet conveyance direction. By changeover section 26 and 36 to change sheet conveyance passes of each of the sheet stacking apparatuses 2 and 3, the sheet P can be ejected from ejection sections 231 and 331 at an upper section of the sheet stacking apparatuses 2 and 3 through first ejection passes 23 and 33, or the sheet P can be stacked on stages 271 and 371 of stacking sections 27 and 37 through stacking passes 25 and 35.

A communication section 12 of the image forming apparatus 1 and communication sections 22 and 32 of the sheet stacking apparatuses 2 and 3 are connected via communication cable 10, and control sections 11, 21 and 31 of each of the devices reciprocate information of an operation state of each section and information of a conveyance state of the sheet P via communication sections 12, 22 and 32. Each communication section is equipped with an unillustrated parallel/serial converter, which carries out conversion of parallel signal data of the control sections 11, 21 and 31 into serial signal data among the communication sections and vice versa, so as to reciprocate information among each of devices via the communication cable 10 configured with a serial communication cable.

Figure 2:
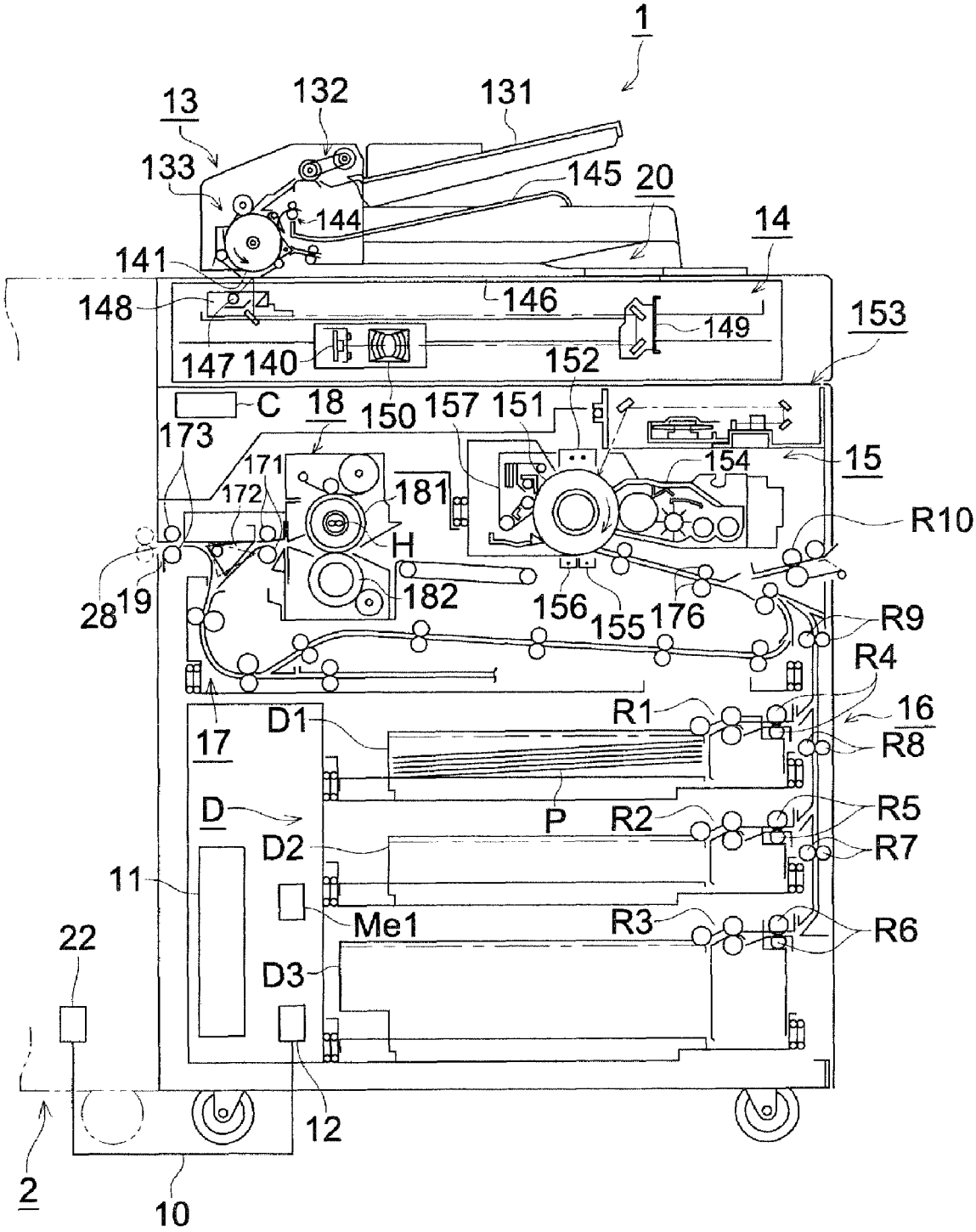
FIG. 2 is a structural view of an image forming apparatus.

FIG. 2 is a structural view of the image forming apparatus.

As FIG. 2 shows, the image forming apparatus 1 is provided with an automatic document feeding section 13, an image readout section 14, an image processing section C, an image forming section 15, a sheet storing section D, a sheet feeding section 16, a sheet reversal conveyance section 17 and an operation display section 20.

The automatic document feeding section 13, feeds the document one by one, conveys the document to an image readout position and ejects the document having been read to a predetermined place. A plurality of pieces of documents placed on the document table 131 are separated one by one through a document separating section 132 and conveyed to the image readout position by a document conveyance section 133.

The document readout position is located under the document conveyance section 133, an image of the document is read through a slit 141 of the image readout section 14. The document from which the image has been read out is ejected to document ejection table 145 by a document ejection section 144. Also, the document can be copied by placing it on a platen glass directly.

The image readout section 14 is to obtain image data by reading the image of the document. In case the automatic document feeding section 13 is used, the slit 141 is irradiated by a lamp 147 for radiating the document, and a first mirror unit 148 and a second mirror unit 149 reflect a reflected light of the document, then the reflected light forms an image through an imaging lens 150 on a CCD 140 in a shape of a line representing an imaging element, thereby a light image of the document is converted by photoelectric conversion. In case the platen glass 146 is used, the first mirror unit 148 and the second mirror unit 149 are shifted so that the imaging lens 150 forms the image of the reflected light on the CCD 140 in the same manner as above and the light image of the document is converted by photoelectric conversion.

An analogue signal converted by photoelectric conversion is converted by A/D conversion after analogue processing and processed by appropriate image processing such as shading correction, filtering processing, and γ correction to be an image data and then stored in a memory Me1 once.

The image forming section 15 forms an image on the sheet P using electrophotographic processing.

To form the image on the sheet P, first, the charging device 152 uniformly charges a surface of a photoconductive drum 151 rotating in a direction shown by an arrow. Thereafter, the photoconductive drum 151 is exposed by dot exposing with a laser writing system 153 based on the image data read out from the memory Me1 so as to form an electrostatic latent image corresponding to the document image, and a developing device 154 develops the electrostatic latent image formed on the photoconductive drum 151 through reversal development to form a toner image.

Subsequently, on the sheet P fed by starting rotation of the registration roller 176 synchronizing with forming of the toner image, a visualized toner image is transferred through a function of a transfer electrode 155, then a discharging device 156 carries out AC corona discharging from a reverse surface of the sheet p on which the toner image has been transferred, so that the sheet P is separated from the surface of the photoconductive drum 151.

Then, the sheet P having been separated is conveyed between a heat roller incorporating a heater H and a pressure roller 182 which rotates while pressing the heat roller 181 of the fixing section 18, and the toner image on the sheet P is pressed and heated at the same time to be fixed.

The sheet P on which the toner image has been fixed, is conveyed to a receiving slot 28 of the sheet stacking apparatus 2 attached to a downstream side in the sheet conveyance direction through fixing ejection rollers 171, a change over section 172, ejection rollers 173 and an ejection slot 19.

Also, a cleaning member 157 cleans the surface of the photoconductive drum 151 after completion of transferring.

Here, feeding of the sheet P to the aforesaid registration roller 176 will be described. Based on the sheet size information inputted by the user from the operation display section 20, the sheet feeding section 16 controlled by control section 11 operates one of the sheet feeding roller sets R1, R2 or R3 of the sheet feeding trays D1, D2 or D3 of the sheet storing section D in which the sheets having a sheet size inputted are stored so as to feed the sheet P having the predetermined sheet size. The sheet P having been fed is conveyed to the registration roller 176 through the conveyance roller pairs (hereinafter called conveyance rollers) R4, R5, R6, R7 and R8.

The sheet reversal conveyance section 17 reverses and conveys the sheet P having been transferred and fixed, and feeds the sheet again P to the image forming section 15 in accordance with a both side image forming mode.

The control section 11 conducts control related to image forming process in the image forming apparatus 1 described above based on information related to image forming inputted from the operation display section 20 and stacking information, and reciprocates information related to each of the sheet stacking apparatuses 2 or 3 and a conveyance status of the sheet P, or information of operation status of each member.

Figure 3:
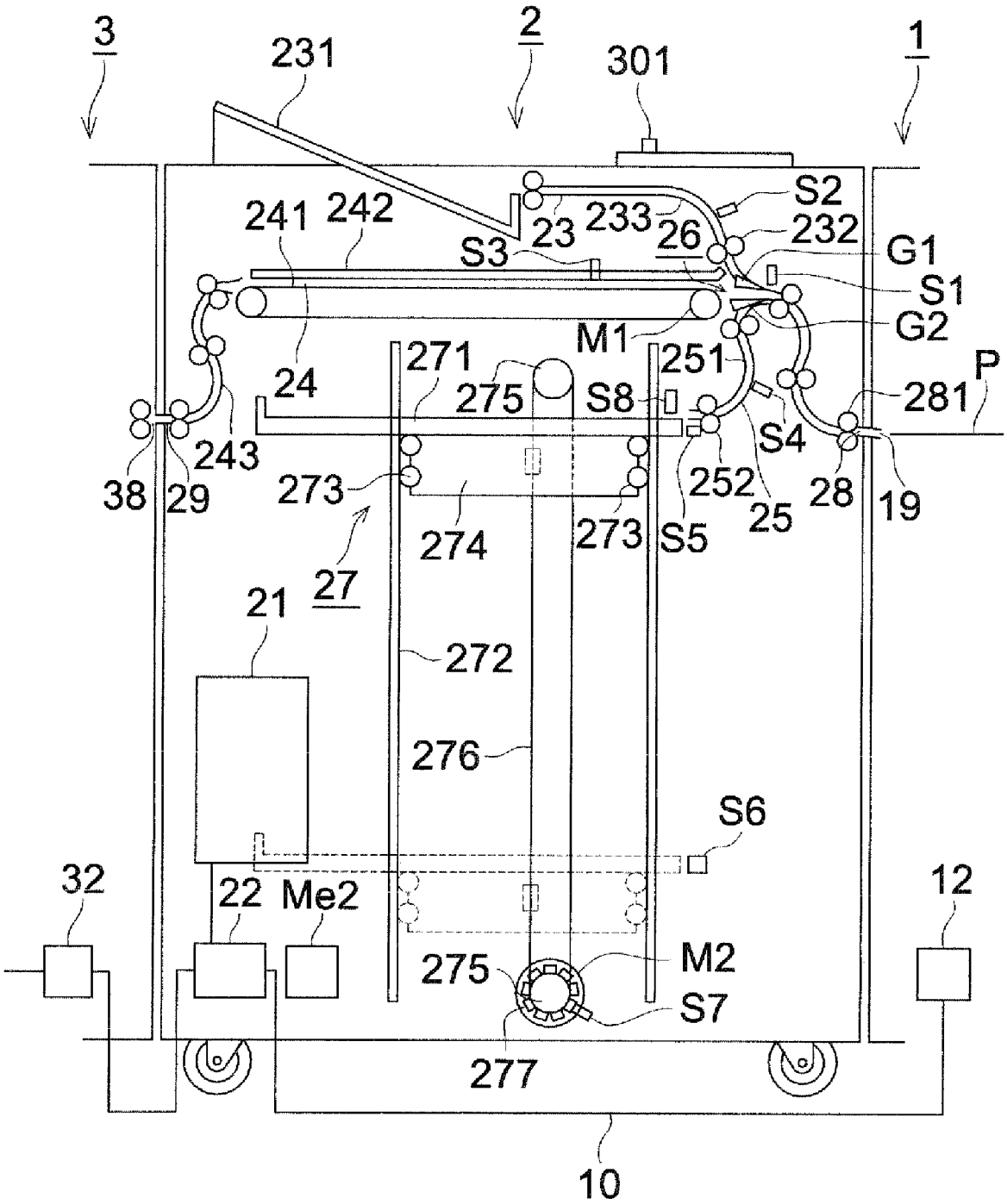
FIG. 3 is a structural view of a sheet stacking apparatus

FIG. 3 is a structural view of the sheet stacking apparatus 2. Meanwhile, since a structure of the sheet stacking apparatus 3 attached to the sheet stacking apparatus 2 is the same as that of the sheet stacking apparatus 2, description of the sheet stacking apparatus 3 is omitted.

A receiving slot 28 and an receiving roller 281 provided in the sheet stacking apparatus 2 are adjusted in the height and the position to meet with the ejection outlet 19 of the image forming apparatus 1.

A conveyance pass arranged at downstream side of the receiving roller 281 is branched into three i.e. a first ejection pass 23, a second ejection pass 24 and stacking pass 25, and by selecting angles of changeover gates G1 and Gs, the sheet P is conveyed one of the passes.

Also, an unillustrated door is provided at an outer panel of the sheet stacking apparatus 2 facing the user. By opening the door, the sheets stacked in the stage 271 can be brought out and jamming sheet can be removed.

Figure 4:
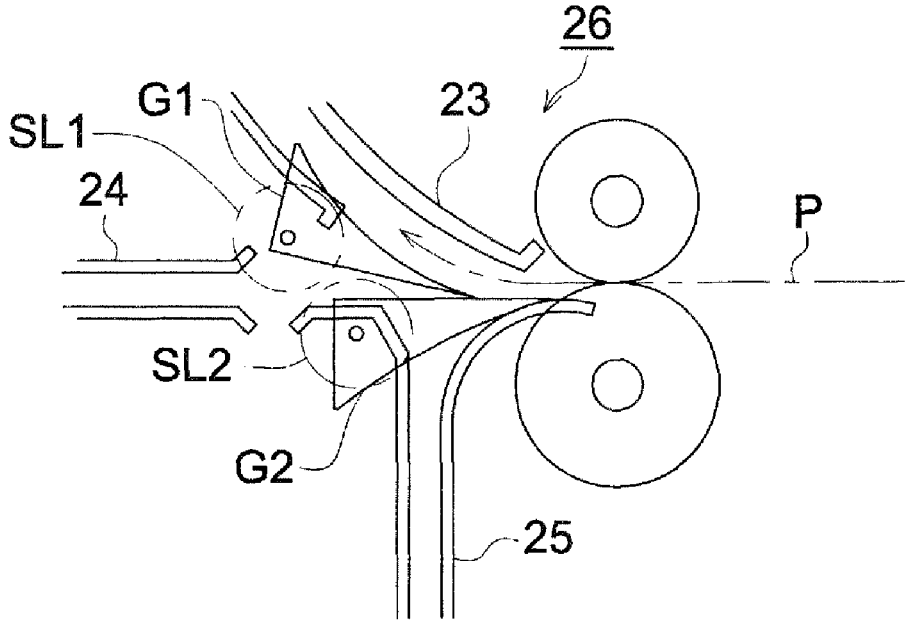
FIG. 4(*a*) and FIG. 4(*b*) are magnified views of a changeover section in the sheet stacking apparatus.
Figure 4:
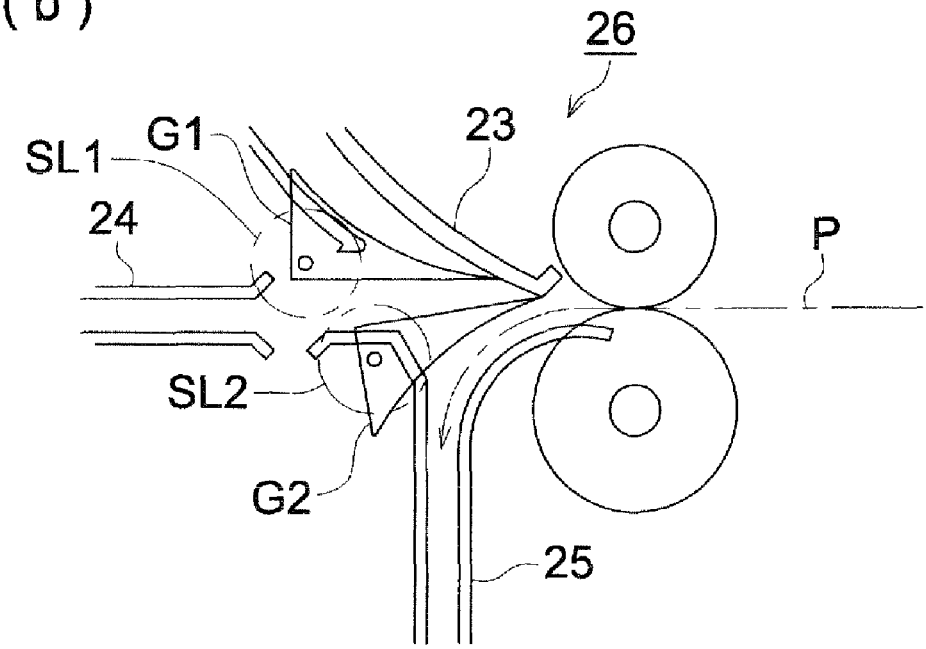

Here, the changeover section 26 to change the conveyance pass of the sheet P will be described with reference to the FIG. 4(*a*) and FIG. 4(*b*). FIG. 4(*a*) shows a state where the conveyance pass of the sheet p is changed to the first ejection pass 23, and FIG. 4(*b*) shows a state where the conveyance pass of the sheet P is changed to the stacking pass 25.

A solenoid SL1 and a solenoid SL2 are driven by a control section 21 via a driver circuit. When the solenoid SL1 is ON and the solenoid SL2 is OFF, as FIG. 4(*a*) shows, an edge of the changeover gate G1 at an upstream side contacts with an upper surface of the change over gate G2 so as to close the second ejection pass 24 and the stacking pas 25, and open the first ejection pass 23. Therefore, since the changeover gate G2 closes the stacking pass 25 without interrupting operation of the changeover gate G1, the sheet P is conveyed to the first ejection pass 23.

Also, when both solenoid SL1 and solenoid SL2 are OFF, an edge of the changeover gate G1 at an upstream side closes the first ejection pass 23 and opens the second ejection pass 24, and then the changeover gate G2 closes the stacking pass 25 and opens the second ejection pass 24, thereby the sheet P is conveyed to the second ejection pass 24.

Also, when the solenoid SL2 is ON and the solenoid SL1 is OFF, as FIG. 4(*b*) shows, an edge of the changeover gate G2 at an upstream side close the first ejection pass 23 and the second ejection pass 24, and opens the stacking pass 25. Therefore, since the changeover gate G1 closes the first ejection pass 23 without interrupting operation of the changeover gate G2, the Sheet P is conveyed to the stacking pass 25.

Getting back to FIG. 3, description of sheet stacking apparatus 2 will be continued.

The sheet P having been conveyed to the first ejection pass 23 is guided by a first ejection guide 233 and conveyed through a plurality of conveyance roller pairs 232, then ejected to the ejection section 231.

Also, while a guide member 242 prevents upper surface of the sheet P conveyed to the second ejection pass 24 from unseating, the sheet P is conveyed through a belt conveyer 241 driven by a motor M1, and through an ejection slot guide 243, the sheet P is ejected towards the receiving slot 38 of the sheet stacking apparatus 3 located at a downstream side from the ejection slot 29.

Further, the sheet P conveyed to the stacking pass 25 is guided by an intermediate guide 251, and conveyed through a plurality of roller pairs 252.

The stage 271 of the stacking section 27 is supported by a stage supporting member 274. The stage supporting section 274 is provided with a plurality of skids 273 at both ends. By rotation of the plurality of skids along the guide member 272 arranged vertically, the stage supporting member 274 ascends and descends as needed.

Also, a pair of pulleys 275 are arranged above and below, and the stage supporting member 274 is fixed onto the wire 276 stretched around the pulleys 275. the stage 271 can be moved to a sheet removing position indicated by broken lines from a sheet stacking position indicated by a solid line through a motor M2 (a driving section) connected to the lower pulley 275. The motor M2 is controlled and rotated by the control section 21 so that the stage 271 can be moved to a selected position.

The upper sensor S5 detects whether or not the stage 271 is at the sheet stacking position representing an upper limit position of the stage 271, and the lower sensor S6 detects whether or not the stage 721 is in the sheet removing position representing a lower limit position of the stage 271.

An output shaft of the motor M2 is provided with projections to provide a bladed wheel 277 so as to detect an amount of rotation. A position sensor S7 is provided to detect the projections of the bladed wheel 277. An output of the position sensor S7 for detecting the projections of the bladed wheel 277 is inputted to the control section 21. By counting a pulse signal of the position sensor S7 which detects the projections, the moving amount of the stage 271 is known and the stage 271 can be stopped at the selected position.

The upper sensor S8 functions as a sheet existence detection device to detect the upper surface of the sheet P stacked on the stage 271. Based on a detection result of the upper sensor S8, by gradually lowering the stage 271, the upper surface of the stage 271 can be positioned at position lower than the ejection position of the stacking pass 25 by a thickness of the sheets P. Also, the upper sensor S8 can detect whether or not the sheet P having been ejected exists on the stage 271.

On the conveyance pass of the sheet P, sensors S1, S2, S3 and S4 are provided to detect jamming of the sheet P.

On an upper part of the sheet stacking apparatus 2, a sheet bring out button 301 is provided. When sheet P stacked on the stage 271 is brought out imperiously, by pressing the sheet bring out button 301, conveyance of sheet p is stopped and the stage 271 is lowered.

The communication section 22 of daisy chain method equipped with an unillustrated parallel/serial converter is connected with a communication section 12 of the image forming apparatus 1 and a communication section 32 of the sheet stacking apparatus 3 via a communication cable 10 configured with a serial communication cable so as to reciprocate information related to a stacking state by the control section 21 of the sheet stacking apparatus 2.

The control section 21 of the sheet stacking apparatus 2 causes a memory Me2 to store information of the communication section 22 as needed, and conducts changeover control of the change over section 26 described above and moving control of the stage 271.

Figure 5:
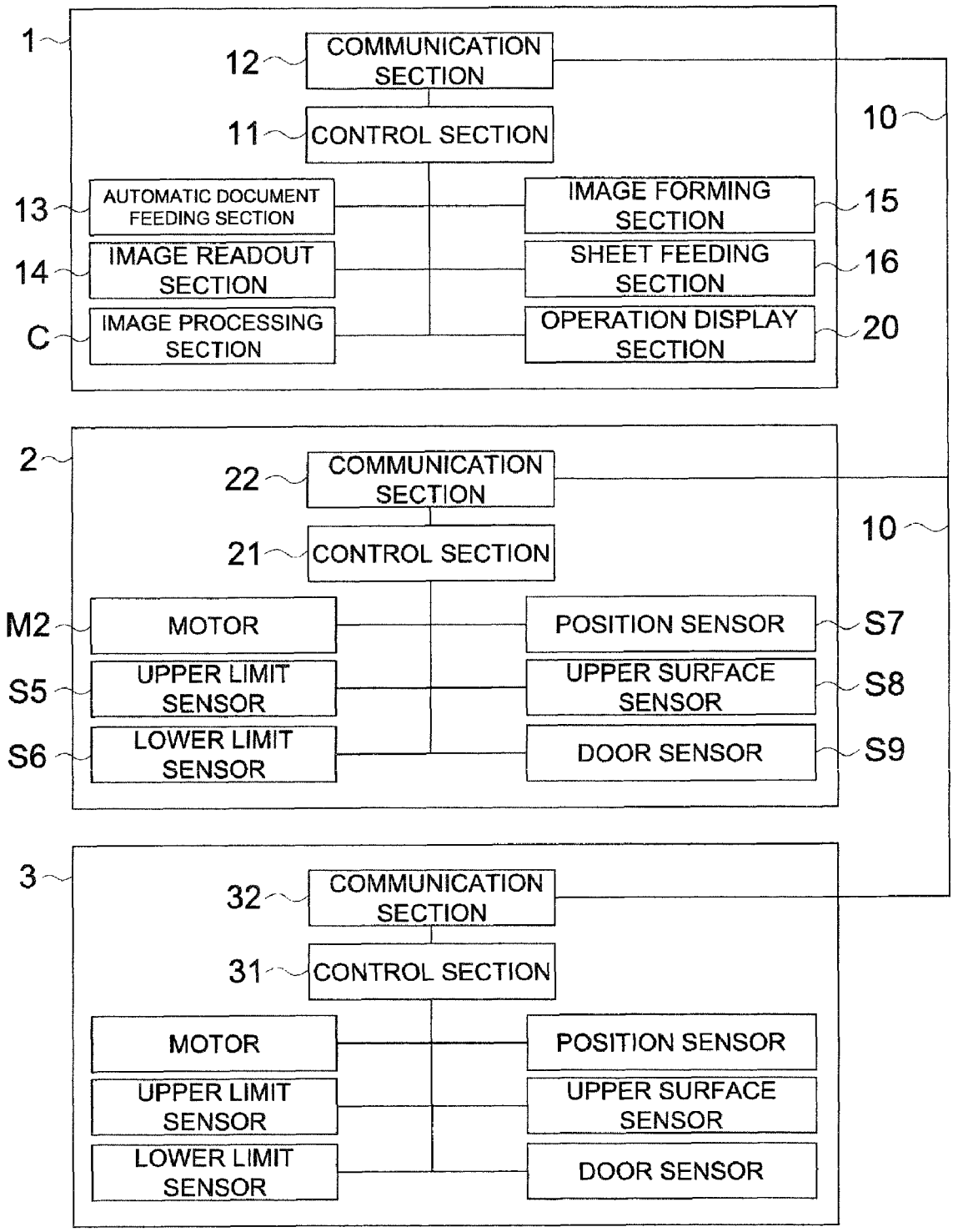
FIG. 5 is a block diagram of a control system of an image forming system.

The FIG. 5 is a block diagram of the control system of the image forming system showing a typical control configuration.

As FIG. 5 shows, the communication section 12 of the image forming apparatus 1 is connected with the communication sections 22 and 32 of the sheet stacking apparatuses 2 and 3 via the communication cable 10 so as to reciprocate information among the devices.

When a job to form an image on the sheet P is carried out in the image forming system 1, the control section 11 controls operation of image forming in the image forming apparatus 1, and when the sheet P on which an image has been formed is ejected to the sheet stacking apparatus 2, attribute information of the job is transmitted from the control section 11 to the control section 21.

When the sheet P is stacked on the stage 271 in the sheet stacking apparatus 2, based on information transmitted from the control section 11, the control section 21 controls operation of a motor M2 so as to ascend or descend the stage 271. Also, the control section 21 controls operation of the motor M2 based on the detection results of the upper limit sensor S5 the lower limit sensor S6, and the upper surface sensor S8 so as to move the stage 271 to an appropriate position.

When the sheet P on which the image has been formed is ejected to the sheet stacking apparatus 3, the attribute information of the job is transmitted from the control section 11 to the control section 31, and the control section 31 controls the operation in the sheet stacking apparatus 3.

As above, the structure of the image forming system has been described using FIG. 1 to FIG. 7. Next, the operation of the job executed in the image forming system will be described specifically.

Figure 6:
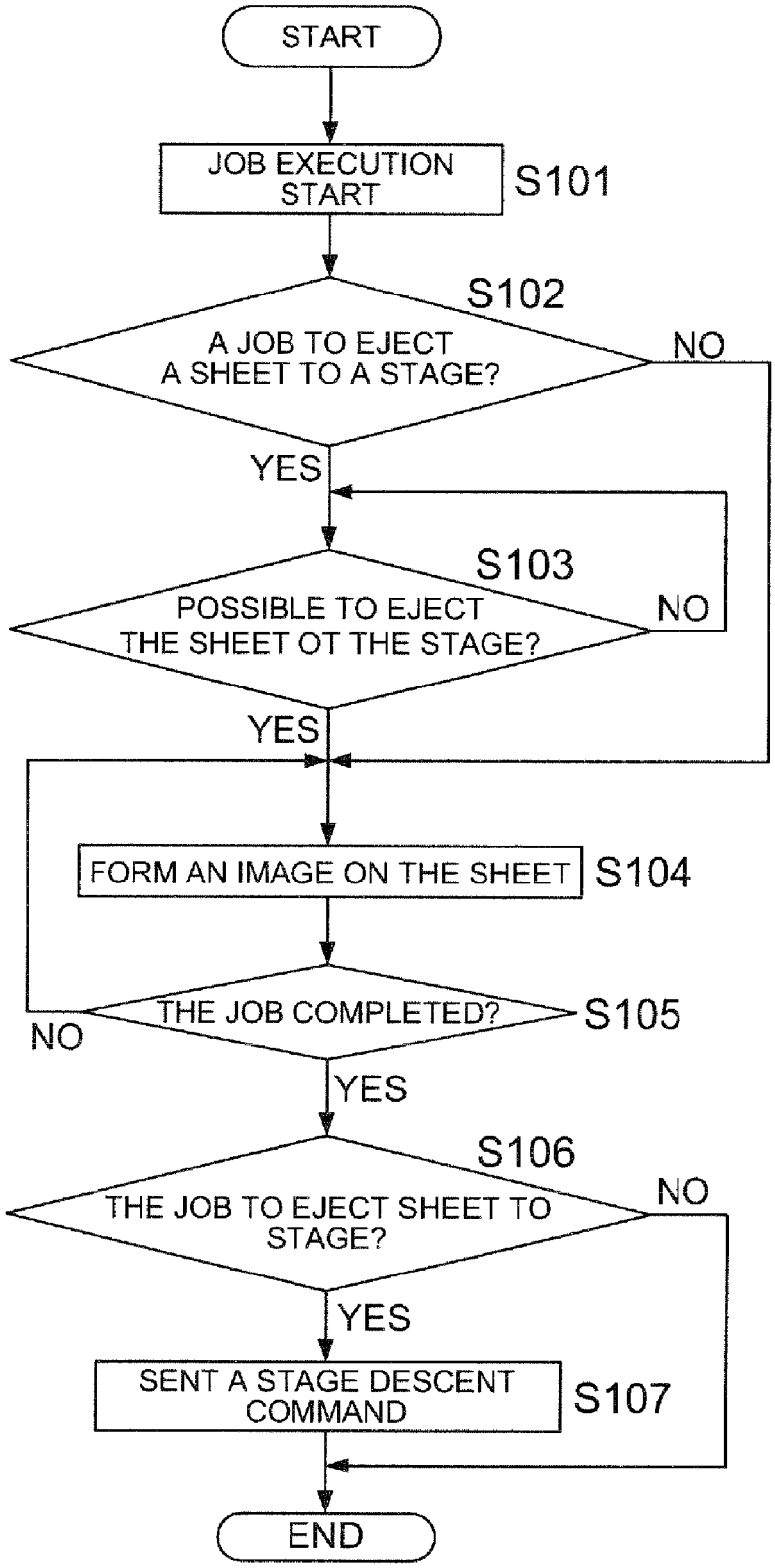
FIG. 6 is a flowchart related to operation of a job to form an image on a sheet in an image forming apparatus.

FIG. 6 is a flow chart concerning operation of the job to form the image on the sheet P in the image forming apparatus 1.

The flow chart shown in FIG. 6 indicates operation of the job to eject the sheet P on which the image has been formed in the image forming apparatus 1 to the sheet stacking apparatus 2. Operation in each step is controlled by the control section 11 of the image forming device 1.

First, a job set through the operation display section 20 of the image forming apparatus 1 or a job received from a network via an outer terminal is started to executed (Step S101).

Then, a job executed in the image forming system is judged whether or not the job is to eject the sheet P to the stage 271 of the sheet stacking apparatus 2 (Step 102). The operation in Step S102 is carried out based on the attribute information of the job. The job not to eject the sheet P to the stage 271 means a job to eject the sheet P to the ejection section 231 located at the upper part of the sheet stacking apparatus 2.

In case of the job to eject the sheet P to the stage 271 (Step S102; Yes), whether or not the sheet P can be ejected to the stage 271 is judged (Step S103). Since the stage 271 of the sheet stacking apparatus 2 can be moved up and down by the motor M2, for example, if the stage 271 is not at the sheet stacking position (the position at which the stage 271 is detected by the sensor S5), the sheet P cannot be ejected to stage 271. Therefore, operation of forming the image on the sheet P is carried out after carrying out operation of Step S103. Meanwhile, a state where the sheet P cannot be ejected to the stage 271 means that the door of the sheet stacking apparatus 2 is open beside the stage 271 being not at the sheet stacking position.

In step s103, if it is judged that the sheet P can be ejected to the stage 271 (Step S103; Yes), the sheet P is fed from the sheet storing section D of the image forming apparatus 1, and an image is formed on the sheet P in the image forming section 15 (Step S104), the sheet P is conveyed to the sheet stacking apparatus 2. The sheet P having been conveyed to the sheet stacking apparatus 2 is ejected by the control section 21 to the stage 271 or the ejection section 231.

Thereafter, the image forming is continued until the job is completed, and after image forming on the sheet P is completed, the when the job to form the image of the sheet P is completed (Step S105; Yes), the job having been completed is judged whether or not it is the job for ejecting the sheet P to stage 271 of the sheet stacking apparatus 2 (Step S106).

In case the job having been completed is not the job to eject the sheet P to the stage 271, namely the job to eject the sheet P to the ejection section 231 (Step S106; No), the operation is terminated. On the other hand, the job having been completed is the job to eject the sheet P to the stage 271, a stage descent command is transmitted from the control section 11 of the image forming apparatus 1 to the control section 21 of the sheet stacking apparatus 2 so that the user can readily bring out the sheet P form the stage 271 (Step S107). Receiving the stage descent command, the control section 21 of the sheet stacking apparatus 2 controls the motor M2 so as to descend the stage 271 readily.

Next, operation to descend the stage 271 of the sheet stacking apparatus 2, when receiving the stage descent command will be described.

Figure 7:
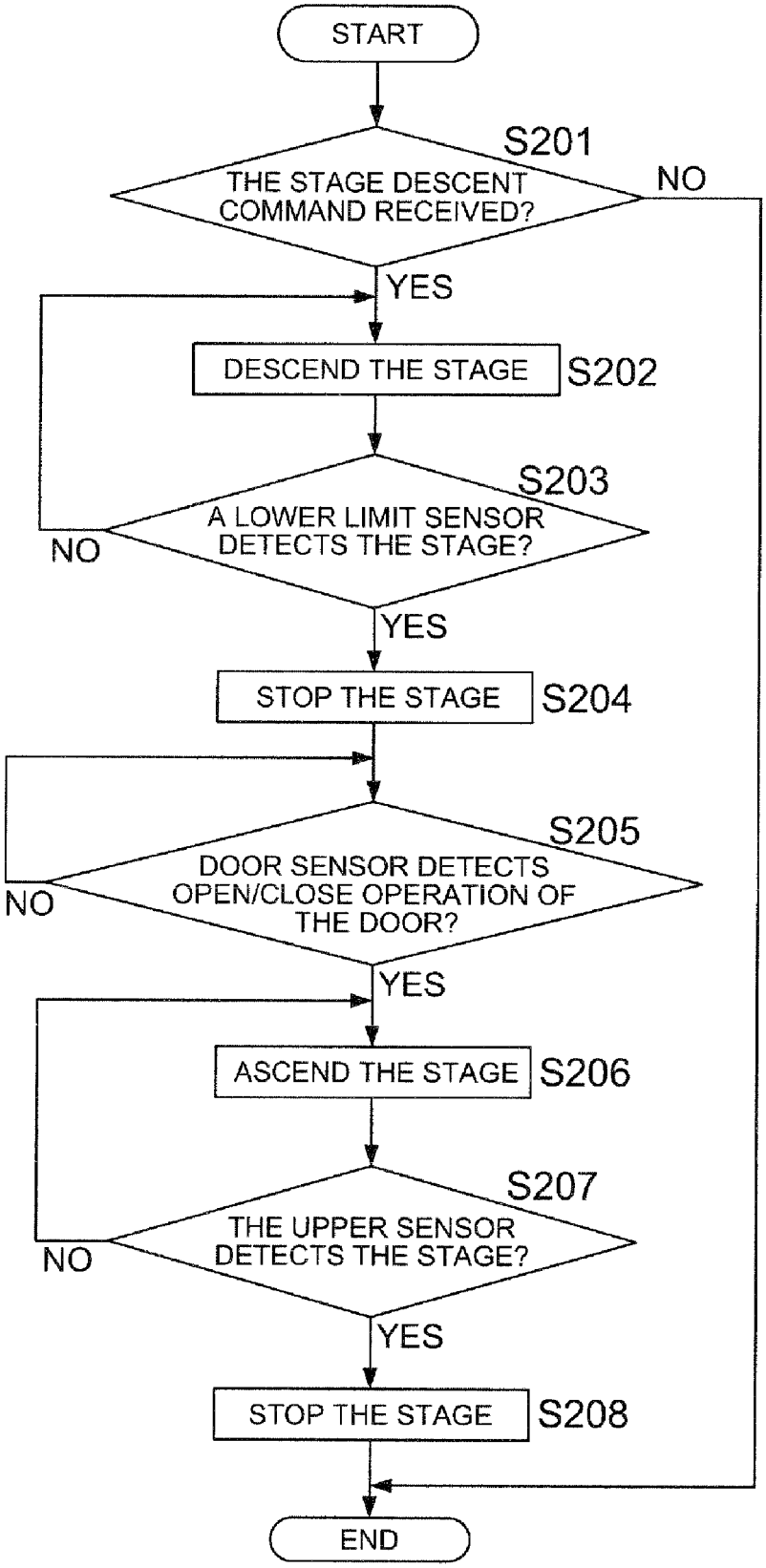
FIG. 7 is a flowchart indicating operation to descend and ascend a stage when a stage descent command is received.
Figure 8:
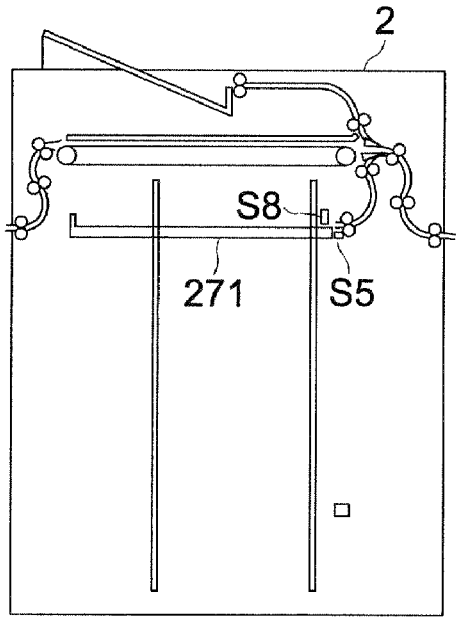
FIG. 8(*a*), FIG. 8(*b*), FIG. 8(*c*) and FIG. 8(*d*) are structural views of a sheet stacking apparatus indicating operation of a stage.
Figure 8:
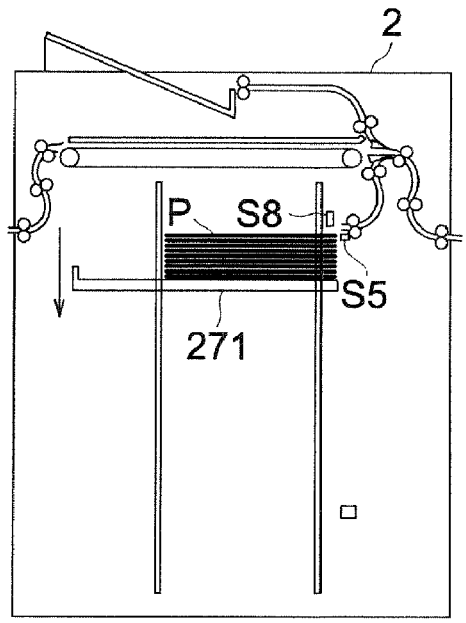
Figure 8:
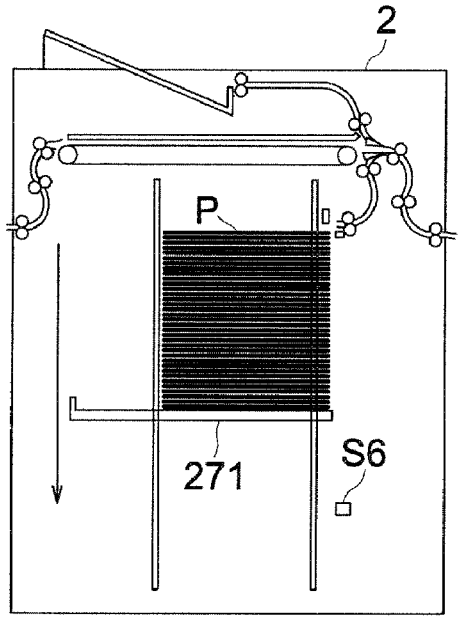
Figure 8:
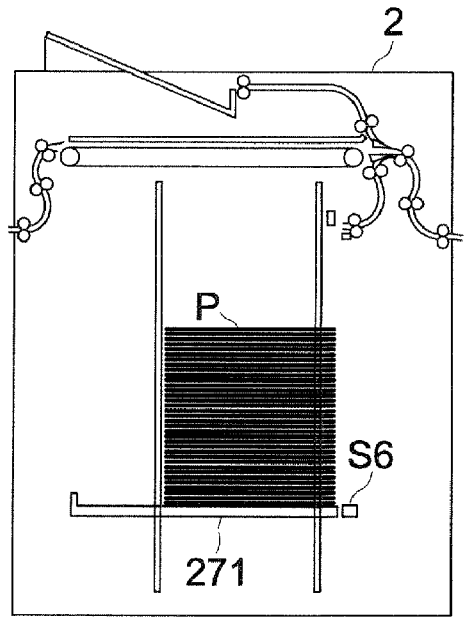

FIG. 7 is a flow chart indicating operation of descent and ascent of the stage 271 when receiving the stage descent command, and the FIG. 8(*a*), (*b*), (*c*) and (*d*) are configuration views showing operation of the stage 271 of the sheet stacking apparatus 2.

In case the sheet P is stacked on the stage 271, as FIG. 8(*a*) shows, the stage 271 is at the sheet stacking position, and whether or not the stage 271 is at the sheet stacking position is detected by the stage upper sensor S5.

When the sheets P are stacked on the stage 271 sequentially, as FIG. 8(*b*) shows, the stage 271 successively descends. The sheet P having been stacked on the stage 271 is detected by the upper surface sensor S8, and the control section 21 controls operation of the motor M2 so that the sheet P on the top of the sheets P having been stacked come to an appropriate position. Namely, the stage 271 is controlled to be lowered in accordance with an amount of the sheets P stacked on the stage 271. By the control thereof, a large amount of the sheets P can be stacked on the stage 271.

Here, operation of descent and ascent of the stage 271 will be described with reference to FIG. 7. The operation of each step shown in FIG. 7 is controlled by the control section 21 of the sheet stacking apparatus 2.

First, whether or not the stage descent command is received from the control section 11 of the image forming apparatus 1 is judged (Step S201). When the stage descent command is received from the control section 11 of the image forming apparatus 1 (Step S201; Yes), the control section 21 of the sheet stacking apparatus 2 controls operation of the motor M2 to descend the stage 271 (Step S202) to a sheet removing position which the lower limit sensor S6 detects.

For example, when the stage descent command is received, in a state shown in FIG. 8(*c*), the stage 271 descends as an arrow shows to the position where the lower limit sensor S6 detects. The position where the lower limit sensor S6 detects the stage 271 is the sheet removing position, and when the stage 271 is at the sheet removing position (refer to the FIG. 8(*d*)), the sheet P stacked on the stage 271 can be bring out by opening the door of the sheet stacking apparatus 2.

As FIG. 7 shows, when the stage 271 descends and is detected by the lower limit sensor S6 (Step s203; Yes), the detection result by the lower limit sensor S6 is propagated to the control section 21, then the control section 21 controls operation of the motor M2 to stop descending of the stage 271 (Step S204). Then sheet P stacked on the stage 271 is brought out by the user.

To ring out the sheet P from the sheet stacking apparatus 2, the door of the sheet stacking apparatus 2 has to be opened, therefore, whether or not the sheet is removed is judged by detecting open/close operation of the door of the sheet stacking apparatus 2 with the door sensor S9 (removing detection device).

When the open/close operation of the door is detected with the door sensor S9 (Step S205; Yes), it is judged that the sheet P stacked on the stage 271 is removed by the user, and to prepare for the subsequent job, the control section 21 controls operation of the motor M2 to ascend the stage 271 (Step S206).

Then, when the upper limit sensor S5 detects the stage 271 (Step S207; Yes), the stage 271 stops (Step S208). At a state where Step S208 is completed, since the stage 271 is at sheet stacking position, the stage 271 becomes ready to stacked the sheet P by executing the subsequent job.

As above descriptions in FIG. 6 to FIG. 8, when the job is completed, by transmitting the stage descent command, the stage 271 is controlled to descended to the sheet removing position automatically, thus since operation by the user is not necessary, the sheet P stacked on the stage 271 can be removed readily without troubling the used.

Meanwhile, in case the job described in FIG. 6 is a mixing prohibition job (a job prohibiting that the sheets P ejected by executing the other jobs are mixed on the stage 271), operation to descend the stage 271 automatically described in FIG. 6 and FIG. 7 can be executed. When the mixing prohibition job is executed, if the stage 271 automatically descends, the sheet P stacked on the stage 271 can be removed and sorting work to sort the sheets P by each job is not necessary.

Next, the other embodiment of the job executed in the image forming system will be described.

Figure 9:
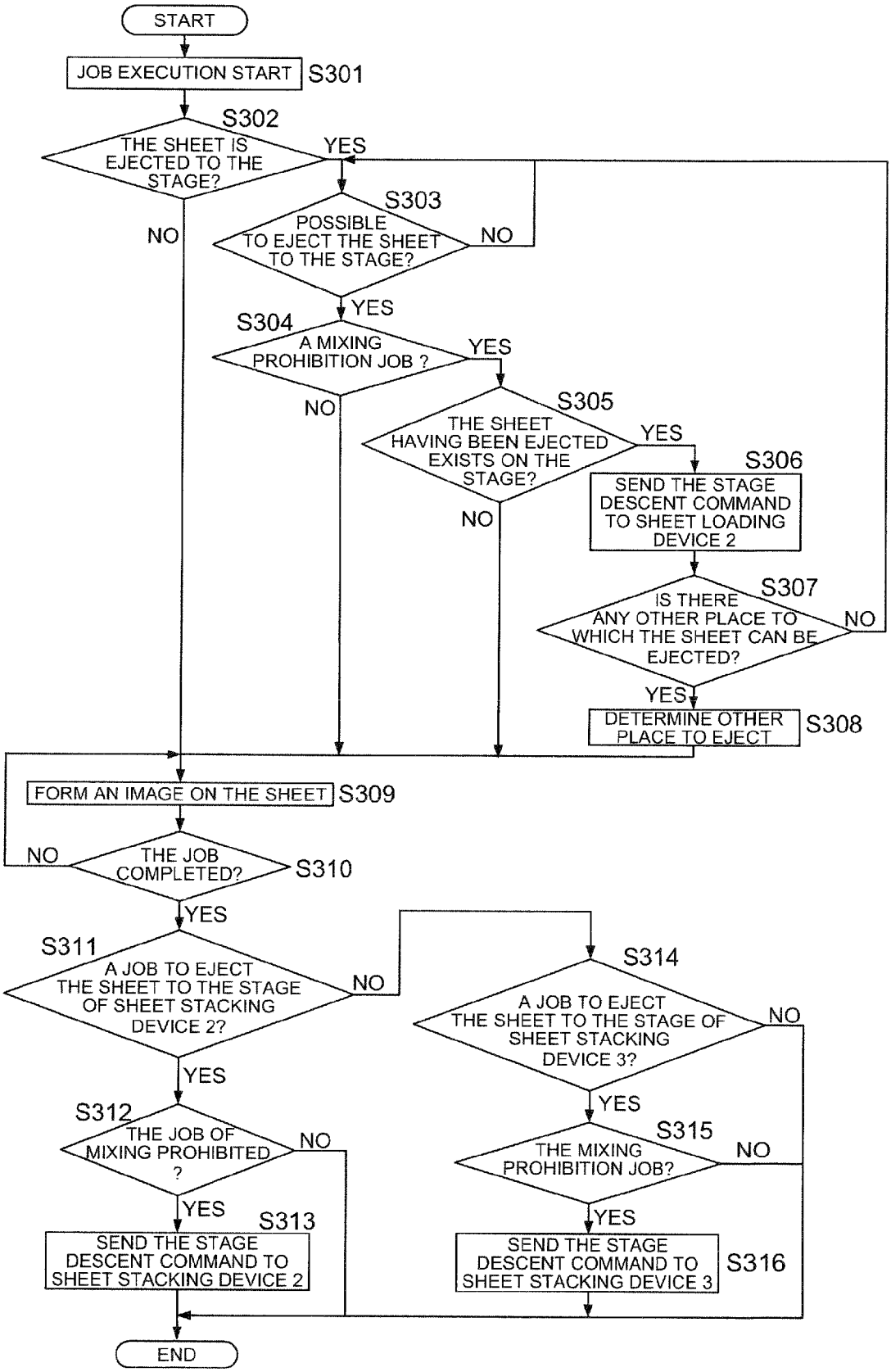
FIG. 9 is a flowchart indicating operation of an image forming system in case of executing a mixing prohibition job and in case a sheet having been ejected is on a stage during execution of a job.

FIG. 9 is a flow chart showing operation of the image forming system in case the sheet P having been ejected exists on the stage when the mixing prohibition job or a job is executed.

The flow chart shown in FIG. 9 shows operation of a job to eject the sheet P on which an image has been formed in the image forming apparatus is ejected to the sheet stacking apparatus 2 or the sheet stacking apparatus 3. Operation of each step is controlled by the control section 11 of the image forming apparatus 1.

First, execution of a job set through the operation display section 20 of the image forming device 1 or a job received from a network via an outer terminal is started (Step S301).

Then, the job executed in the image forming system is judged whether or not the job is to eject the sheet P to the stage 271 of the sheet stacking apparatus 2 (Step 302). The operation in Step S302 is carried out based on the attribute information of the job. The job not to eject the sheet P to the stage 271 means a job to eject the sheet P to the ejection section 231 located at the upper part of the sheet stacking apparatus 2.

In case of the job to eject the sheet P to the stage 271 (Step S302; Yes), whether or not the sheet P can be ejected to the stage 271 is judged (Step S303). Since the stage 271 of the sheet stacking apparatus 2 can be moved up and down by the motor M2, for example, if the stage 271 is not at the sheet stacking position (the position at which the stage 271 is detected by the sensor S5), the sheet P cannot be ejected to stage 271. Therefore, operation of forming the image on the sheet P is carried out after carrying out operation of Step S303.

In Step S303, if it is judged that the sheet P can be ejected to the stage 271 (Step S303; Yes), whether or not the job to be executed subsequently is the mixing prohibition job is judged (Step S304).

If the job executed subsequently is not the mixing prohibition job (Step S304; No), since it is not a problem that the sheet P having been ejected is stacked on the stage 271, Step S309 is executed directly.

On the other hand, the job to be executed next is the mixing prohibition job (Step S304; Yes), whether or not the sheet P having been ejected exits is judged (Step S305). If the mixing prohibition job is executed in a state where the sheet P having been ejected exists on the stage 271, the sheets P will be mixed on the stage 271. Thus Step S305 is executed. Whether or not the sheet P having been ejected exists is detected by the upper surface sensor S8, or an exclusively used sensor can be provided for detection.

In case the sheet P having been ejected does not exist on the stage 271 (Step S305; No), Step S309 is executed directly, however, in case the sheet P having been ejected exists on the stage 271 (Step S305; Yes), for user to removing the sheet P stacked on the stage 271, a stage descent command is sent from the control section 11 of the image forming apparatus 1 to the control section 21 of the sheet stacking apparatus 2 (Step S306). The control section 21 of the sheet stacking apparatus 2 having received the stage descent command executes the operation shown by FIG. 8 (The stage 271 descends to the sheet removing position. Then after the sheet P is removed, the stage 271 ascends to the sheet stacking position). Thereby, the user can remove the sheet P having been ejected on the stage 271 readily with a minimum of fuss.

In Step S306, while the stage 271 is descending, the sheet P cannot be ejected to the stage 271. Therefore, in order to eject the sheet P by executing the subsequent mixing prohibition job, whether or not other places capable of ejecting the sheet P are available is judged (Step S307). The other places capable of ejection means a stage 371 of the sheet stacking apparatus 3, an ejection section 331 or an ejection section 231 of the sheet stacking apparatus 2. Operation of Step S307 is executed by the control section 11 to receive status information of the stage 371 and the ejection sections 231 and 331 from the control sections 21 and 31. For example, if sheet P can be ejected to the stage 371 of the sheet stacking apparatus 3, the sheet P is ejected to the stage 371 by priority.

In Step S307, if not other places capable of ejection are available (Step S303; No), execution of the mixing prohibition job is held until the stage 271 becomes available for ejection, and if the places capable of ejection are available (Step S307; Yes), the control section 11 determines the other ejection place (Step S308), the control section 11 sends a predetermined information to the control section 21 or the control section 31 so as to eject the sheet P to the other ejection place determined (for example, the stage 371 of the sheet stacking apparatus 3). In this way, the mixing prohibition job can be executed readily.

Next, the sheet P is fed from the sheet storing section D of the image forming apparatus 1, the image forming section 15 forms an image on the sheet P (Step S309), and the sheet P is conveyed to the sheet stacking apparatus 2 or sheet stacking apparatus 3. The sheet P having been conveyed to the sheet stacking apparatus 2 or sheet stacking apparatus 3 is ejected to a predetermined ejection place (for example, stage 271).

Then, image forming onto the sheet P is continued until the job is completed, and when the job to form the image on the sheet P is completed (Step S310; Yes), first, the job having been completed is judged whether or not the job is to eject the sheet P to the stage 271 of the sheet stacking apparatus 2 (Step S311).

In case the job having been completed is the job to eject the sheet P to the stage 271 (Step S311; Yes), the job having been completed is judged whether or not the job is a mixing prohibition job (Step S312). Then if the job having been completed is not the mixing prohibition job (Step S312; No), the job is terminated directly, since it is not a problem that the sheet to be ejected in subsequent job is staked on the stage 271. However, if the job having been completed is the mixing prohibition job (Step S312; Yes), for the user to remove the sheet P on the stage 271, the control section 11 of the image forming apparatus 1 sends the stage descent command to the control section 21 of the sheet stacking apparatus 2 (Step S313). The control section 21 of the sheet stacking apparatus 2 having received the stage descent command executes the operation shown by FIG. 8 (The stage 271 descends to the sheet removing position. Then after the sheet P is removed, the stage 271 ascends to the sheet stacking position). As above, by descending the stage 271 automatically at the mixing prohibition job, the sheets P can not be mixed by executing the other jobs, therefore, the sheet P stacking on the stage 271 can be removed readily.

In the Step S311, if the job having been completed is not the job to eject the sheet P to the stage 271 (Step S311; No), the job to be completed subsequently is judged whether or not the job is to eject the sheet P to the stage 371 of the sheet stacking apparatus 3 (Step S314), and if it is not the Job to eject the sheet P to the stage 371 (Step S314; No), operation is terminated directly.

On the other hand, if the job having been completed is a job to eject the sheet P to the stage 371 (Step S314; Yes), the job having been completed is judged whether or not the job is the mixing prohibition job (Step S315). If the job having been completed is not the mixing prohibition job (Step S315; No), operation is terminated directly, since it is not a problem that the sheet P ejected by the subsequent job is staked on the stage 371, however if the job having been completed is the mixing prohibition job (Step S315; Yes), for the user to remove the sheet P on the stage 371, the control section 11 of the image forming apparatus 1 sends the stage descent command to the control section 31 of the sheet stacking apparatus 3 (Step S316). The control section 31 of the sheet stacking apparatus 3 having received the stage descent commend executes the same operation as in FIG. 8 (Stage 371 descends to the sheet removing position, then after the sheet P is removed, the stage 371 ascends to the sheet stacking position). As above, by descending the stage 371 automatically in the mixing prohibition job, the sheets P can not be mixed by executing the other jobs, therefore, the sheet P stacking on the stage 371 can be removed readily.

Meanwhile, in case a job to eject the sheet P to the stage 271 of the sheet stacking apparatus 2 or the stage 371 of the sheet stacking apparatus 3 where operation of Step S312 or Step S315 is omitted, the stage descent command can be sent immediately to the sheet stacking apparatus 2 or the sheet stacking apparatus 3.

As above, also in the operation such as in FIG. 9, when the job is completed, by sending the stage descent command, the stage 271 or the stage 371 is controlled and descend to the sheet removing position automatically, thereby it is not necessary for the user to operate the stage 271 or stage 371 for descent and sheet P stacked on the stage 271 or stage 371 can be removed readily by the user with a minimum of fuss.

Meanwhile, the present invention is not limited to the embodiment thereof and it is to be understood that changes and variations made without departing from the spirit or scope of the present invention are included in the present invention.

In the image forming system of the present embodiment, while three apparatuses i.e. the image forming apparatus 1, the sheet stacking apparatus 2, and the sheet stacking apparatus 3, are connected, an image forming system where three apparatuses are integrated is included in the scope of the present invention.

What is claimed is:

1. A sheet stacking apparatus which is attachable to an image forming apparatus that executes a job for forming an image on a sheet, and which stacks sheets ejected from the image forming apparatus, the sheet stacking apparatus comprising:

a stage to receive a sheet ejected from the image forming apparatus;

a sheet detection device to detect whether or not any sheet is present on the stage;

a driving section to move the stage; and a control section to control the driving section to move the stage;

wherein, in a case in which job attribute information set in the image forming apparatus indicates that the job executed by the image forming apparatus is a mixing prohibition job, the control section controls the driving section to move the stage to a sheet removing position automatically, when an output of the sheet detection device indicates that a sheet of a previous job is present on the stage, so as to prevent the sheet of the mixing prohibition job from mixing with the sheet of the previous job; and wherein in a case in which job attribute information set in the image forming apparatus indicates that the job executed by the image forming apparatus is not a mixing prohibition job, the job is executed irrespective of whether the sheet of the previous job is present on the stage.

2. The sheet stacking apparatus of claim 1, further comprising a removal detection device to detect that the sheet is removed from the stage at a sheet removing position, wherein the control section controls the driving section to move the stage to a sheet stacking position automatically when the removal detection device detects that the sheet is removed.

3. The sheet stacking apparatus of claim 1, wherein the control section controls the driving section so that the stage descends in accordance with an amount of the sheets.

4. An image forming system, comprising the image forming apparatus and the sheet stacking apparatus of claim 1.

* * * * *